US006068959A

United States Patent [19]

Nakamura et al.

[11] Patent Number: 6,068,959

[45] Date of Patent: May 30, 2000

[54] COATED CARRIER FOR DEVELOPING ELECTROSTATICALLY CHARGED IMAGES

[75] Inventors: Toru Nakamura, Abiko; Toshimi Nishioka, Suita; Takuya Hoga, Urawa; Nobuyuki Kurokawa, Tokyo; Junichi Fukuzawa, Yokohama, all of Japan; Horst-Tore Land, Hofheim; Fredy Helmer-Metzmann, Essenheim, both of Germany

[73] Assignees: Hoechst Research & Technology; Deutschland GmbH & Co. KG, both of Frankfurt, Germany

[21] Appl. No.: 09/000,372

[22] PCT Filed: Jul. 29, 1996

[86] PCT No.: PCT/JP96/02135

§ 371 Date: May 20, 1998

§ 102(e) Date: May 20, 1998

[87] PCT Pub. No.: WO97/24644

PCT Pub. Date: Jul. 10, 1997

[30] Foreign Application Priority Data

Dec. 29, 1995 [JP] Japan ..... 7-354064

[51] Int. Cl.[7] ..... G03G 9/113

[52] U.S. Cl. ..... 430/108

[58] Field of Search ..... 430/108

[56] References Cited

U.S. PATENT DOCUMENTS

| | | | |
|---|---|---|---|
| 3,898,170 | 8/1975 | Kasper | 430/108 |
| 4,039,331 | 8/1977 | Lee | 430/120 |
| 5,100,754 | 3/1992 | Yoerger et al. | 430/108 |
| 5,215,848 | 6/1993 | Ikeda et al. | 430/108 |
| 5,272,037 | 12/1993 | Ohtani et al. | 430/108 |
| 5,491,042 | 2/1996 | Sato et al. | 430/108 |
| 5,631,116 | 5/1997 | Uchida et al. | 430/108 |

FOREIGN PATENT DOCUMENTS

| | | | |
|---|---|---|---|
| 2176899 | 11/1973 | France . | |
| 60-60656 | 4/1985 | Japan | 430/108 |
| 63-002077 | of 1988 | Japan . | |

OTHER PUBLICATIONS

Xerox Discl. Jour., vol. 2, No. 1, Jan./Feb. 1977, Surface Modification of Polymers, p. 27.

*Primary Examiner*—Roland Martin
*Attorney, Agent, or Firm*—Frommer Lawrence & Haug LLP

[57] ABSTRACT

This invention relates to a coated carrier for development of an electrostatically charged image, comprising carrier core particles coated with a coating resin; wherein the coating resin at least includes a polyolefin resin having a cyclic structure; a polyolefin resin of a cyclic structure having an intrinsic viscosity (i.v.) of 0.25 dl/g or more, a heat distortion temperature (HDT) by DIN53461-B of 70 ° C. or higher, and a number average molecular weight of 7,500 or more and a weight average molecular weight of 15,000 or more, as measured by GPC, is contained in an amount of less than 50% by weight based on the entire coating resin; and the coating resin is used for coating in an amount of 1 to 30% by weight based on the carrier core particles. The present invention can obtain a coated carrier which exhibits high anti-spent toner effect and excellent charge control properties during development with a dry toner.

6 Claims, No Drawings

COATED CARRIER FOR DEVELOPING ELECTROSTATICALLY CHARGED IMAGES

TECHNICAL FIELD

The present invention relates to a coated carrier for development of an electrostatically charged image. More specifically, this invention provides a coated carrier having a satisfactory anti-spent toner effect and excellent charge control properties when developing an electrostatically charged image with a dry toner, thereby providing a sharp and stable image.

BACKGROUND ART

Electrostatically charged image development type copiers and printers are gaining popularity because of widespread office automation. With this background, demand is growing for high grade or sharp, stable copied or printed images. General formulations for carriers in electrostatically charged image developing copiers and printers are shown in Table 1. One of the main factors for improving the sharpness and stability of a copy image is a surface coating resin of the carrier. An electrostatically charged image developing copier or printer feeds a toner to an electrostatically charged image on a latent image carrier to obtain a visible image, then transfers the resulting toner image to a plain paper or an OHP film, and fixes the transferred image. Currently, developers comprising toner particles electrostatically joined to carrier particles of iron powder or carrier particles of ferrite consisting essentially of nickel or cobalt are in wide use as means of supplying toner to the electrostatically charged image on the latent image carrier to obtain the visible image. For the surface of these carriers, fluoro-acrylic graft polymer, cellulose butyl acetate, or silicone resin is used as a coating material to impart charge control properties and anti-spent toner effect (spent toner phenomenon is a phenomenon in which the toner adhering to the surface of the carrier is firmly bonded to the carrier electrostatically, physically or chemically, and thus the toner is not transferred to the electrostatically charged image on the latent image carrier). The coating material proves satisfactory in a copy image initially formed. During its long-term use, however, toner particles that have triboelectrically adhered to carrier particles become difficult to separate from the carrier owing to the accumulation of electrostatic charges between the toner and the carrier. Alternatively, the adhering toner particles are fusion bonded to the carrier surface because of heat of friction, so that the replenishing toner is not charged. As a result, replenishment of toner to the electrostatically charged image on the latent image carrier is insufficient, causing image deterioration, namely, short life of the developer.

TABLE 1

| | Core substance | (% by weight) Surface coating agent |
|---|---|---|
| Iron oxide powder type carrier | Iron oxide powder 70–99 | 1–30 |
| Ferrite type carrier | Ferrite powder 70–99 | 1–30 |

The present invention has been accomplished in the light of the aforementioned problems. The object of this invention is to provide a coated carrier which is capable for achieving a higher grade copy image, that is, a sharp image, and a long life of the developer, in an electrostatically charged image development type copier or printer.

DISCLOSURE OF THE INVENTION

A first aspect of the present invention is to provide a coated carrier for development of an electrostatically charged image, the coated carrier comprising carrier core particles coated with a coating resin; wherein the coating resin at least includes a polyolefin resin having a cyclic structure;

a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in an amount of less than 50% by weight based on the entire coating resin; and the coating resin is used for coating in an amount of 1 to 30% by weight based on the carrier core particles.

A second aspect of the invention is to provide the coated carrier for development of an electrostatically charged image regarding the first aspect of the invention, wherein the coating resin consists of 1 to 100 parts by weight of a polyolefin resin having a cyclic structure, and 0 to 99 parts by weight of at least one resin selected from fluoroacrylic graft polymer, cellulose butyl acetate, and silicone resins.

A third aspect of the invention is to provide the coated carrier for development of an electrostatically charged image according the first or second aspect of the invention, wherein the polyolefin resin having a cyclic structure has at least one functional group selected from a carboxyl group, a hydroxyl group and an amino group.

A fourth aspect of the invention is to provide the coated carrier for development of an electrostatically charged image regarding the first, second or third aspect of the invention, wherein the polyolefin resin having a cyclic structure is an ionomer, or has a structure crosslinked with dienes.

To solve the aforementioned problems, we, the inventors, have worked out a measure covering the use of a resin with excellent charge control properties, satisfactory surface lubricating properties, and high rub resistance. Examples of such a resin are fluoro-acrylic graft polymer, cellulose butyl acetate, and silicone resins. These resins, however, are known to be unsatisfactory in terms of the properties required of carrier surface coating resins, such as charge control properties, surface lubricating properties, and rub resistance, and to be questionable when used as coating resins. We have conducted extensive studies to correct these drawbacks, and have found that a carrier providing a high grade image and a long life developer can be produced by using a colorless, transparent polyolefin resin of a cyclic structure which can satisfy the charge control properties, surface lubricating properties, and rub resistance, wherein the polyolefin resin contains less than 50% by weight of a high-viscosity resin based on the entire coating resin. This finding has led us to accomplish the present invention. A carrier using as a carrier surface coating resin a polyolefin resin of a cyclic structure fulfilling these characteristics imparts excellent anti-spent toner effect and charge control properties. The use of a developer using this carrier has been found to achieve a high grade, sharp image.

The carrier for development of an electrostatically charged image of the present invention has a coating resin, wherein the coating resin at least includes a polyolefin resin having a cyclic structure, and a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in an amount of less than 50% by weight based on the entire coating resin.

The polyolefin resin having a cyclic structure used herein is, for example, a copolymer of an alpha olefin, such as ethylene, propylene or butylene, with an alicyclic compound having a double bond, such as cyclohexene or norbornene, which copolymer is colorless and transparent, and has high light transmittance. This polyolefin having a cyclic structure is a polymer obtained, for instance, by a polymerization method using a metallocene catalyst or a Ziegler catalyst.

Preferred as the colorless, transparent polyolefin resin of a cyclic structure with satisfactory charge control properties, surface lubricating properties and rub resistance used in the present invention are a low-viscosity resin having a number average molecular weight of 1,000 to 7,500, preferably 3,000 to 7,500, and a weight average molecular weight of 1,000 to 15,000, preferably 4,000 to 7,500, as measured by GPC, an intrinsic viscosity (i.v.) of less than 0.25 dl/g, and a heat distortion temperature (HDT) by DIN53461-B of lower than 70° C., and a high-viscosity resin having a number average molecular weight of 7,500 or more, preferably 7,500 to 50,000, and a weight average molecular weight of 15,000 or more, preferably 15,000 to 100,000, as measured by GPC, an i.v. of 0.25 dl/g or more, and an HDT of 70° C. or higher.

The high-viscosity polyolefin resin having a cyclic structure has the aforesaid properties. Compared with the same resin with a low viscosity, therefore, this resin can improve the mechanical strength, such as rub resistance, of the resulting carrier coating, and also ensures the adhesion strength of the coating onto the carrier particles. However, if the proportion of the high-viscosity polyolefin resin having a cyclic structure is 50% or more, the anti-spent toner properties will be impaired.

In the present invention, a coated carrier using a coating resin comprising a mixture of other resin with the polyolefin resin having a cyclic structure, which satisfies the foregoing characteristics, also achieves a high grade, sharp image. In this case, it is preferred that the proportions of the polyolefin resin having a cyclic structure and the other resin in the coating resin is to be 1 to 100, preferably 20 to 90, more preferably 50 to 90 parts by weight of the former, and 0 to 99, preferably 10 to 80, more preferably 10 to 50 parts by weight of the latter. If the amount of the former resin is less than 1 part by weight, it becomes difficult to obtain a high grade image and a long-life developer.

If a carboxyl group is introduced into the polyolefin resin having a cyclic structure by the melt air oxidation method or modification with maleic anhydride, its compatibility with the other resin and the dispersibility of the pigment can be improved. The same improvement can be achieved by introducing a hydroxyl group or an amino group by a known method.

Furthermore, the rub resistance and the anti-spent toner properties can be further improved by copolymerizing the polyolefin resin having a cyclic structure with a diene monomer such as norbornadiene or cyclohexadiene, or by introducing a crosslinking structure into the polyolefin resin of a cyclic structure, which has a carboxyl group introduced therein, by adding a metal such as zinc, copper or calcium.

In the present invention, the polyolefin resin having a cyclic structure is coated as a surface coating agent onto carrier core particles comprising iron powder or ferrite. The amount of the coating polyolefin resin is 1 to 30% by weight based on the carrier core particles, and the method of coating is by such means as a spray dryer. If the amount of the coating is less than 1% by weight, the surface of the carrier cannot be fully coated, thereby lowering the anti-spent toner effect. If the amount of the coating is more than 30% by weight, stable charge control properties are not obtained. A developer using the coated carrier of the present invention gives a sharp image and long-term stability of image quality.

For the toner comprising of the coated carrier of the present invention and a developer, the particles are used, which consist essentially of a binder resin, a coloring agent, a charge control agent and other additives added thereto, where necessary.

As the binder resin there may be used any known ones. Examples include homopolymers of styrene and its substituted compounds, such as polystyrene, poly p-chlorostyrene and polyvinyltoluene; styrene copolymers, such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyesters; polyurethanes; polyamides; epoxy resins; polyvinyl butyral; polyacrylates; rosin; modified rosin; terpene resin; phenolic resins; aliphatic or alicyclic hydrocarbon resins; aromatic petroleum resins; chlorinated paraffin; and paraffin wax. These compounds may be used alone or in combination.

The coloring agent may be a known one, such as carbon black, diazo yellow, phthalocyanine blue, quinacridone, carmine 6B, monoazo red or perylene.

Examples of the charge control agent are known ones such as Nigrosine dyes, fatty acid modified Nigrosine dyes, metallized Nigrosine dyes, metallized fatty acid modified Nigrosine dyes, chromium complexes of 3,5-di-tert-butylsalicylic acid, quaternary ammonium salts, triphenylmethane dyes, and azochromium complexes.

To the toner of the present invention, there may be further added a flowing agent such as colloidal silica, aluminum oxide or titanium oxide, and a lubricant comprising a fatty acid metal salt such as barium stearate, calcium stearate or barium laurate.

The present invention will be described in more detail by reference to Examples and Comparative Examples.

CARRIER PREPARATION METHOD

Five parts by weight of a surface coating agent was coated onto 95 parts by weight of iron powder or ferrite powder of core substance, by means of a spray dryer, to obtain a carrier for a dry two-component developer.

Example 1

95 Parts of iron powder (TEF-V150, Powdertech) was coated with a solution of 5 parts of T-745 (the polyolefin resin having a cyclic structure recited in claim 1) in toluene by means of a spray dryer to obtain a carrier.

Example 2

95 Parts of iron powder (TEF-V150, Powdertech) was coated with a toluene solution of 5 parts of a mixture of T-745 and S-8007 (the polyolefin resin having a cyclic structure recited in claim 1 that was prepared by mixing both compounds at a 60:40 ratio using a kneader) by means of a spray dryer to obtain a carrier.

Example 3

A mixture of T-745 and fluoro-acrylic graft polymer resin (LF-40, Soken Kagaku) (the coating resin containing a cyclic polyolefin resin recited in claim 2 that was prepared by mixing both compounds at a 50:50 ratio using a kneader) was coated on the surface of iron powder (TEF-V150, Powdertech) in the same manner as in Example 1 to obtain a carrier.

Example 4

T-745-MO (the polyolefin resin having a cyclic structure recited in claim 3 that was prepared by adding a carboxyl group to T-745 by melt air oxidation) was coated on the surface of iron powder (TEF-V150, Powdertech) in the same manner as in Example 1 to obtain a carrier.

Example 5

T-745-CL (the polyolefin resin having a cyclic structure recited in claim 4 that was prepared by adding a peroxide to an ethylene-norbornene-norbornadiene terpolymer to crosslink it) was coated on the surface of iron powder (TEF-V150, Powdertech) in the same manner as in Example 1 to obtain a carrier.

Example 6

95 Parts of ferrite powder (a product of Powdertech) was coated with a solution of 5 parts of T-745 (the polyolefin resin having a cyclic structure recited in claim 1) in toluene by means of a spray dryer to obtain a carrier.

Example 7

A mixture of T-745 and S-8007 (the polyolefin resin having a cyclic structure recited in claim 1 that was prepared by mixing both compounds at a 60:40 ratio using a kneader) was coated on the surface of ferrite powder (a product of Powdertech) in the same manner as in Example 6 to obtain a carrier.

Example 8

A mixture of T-745 and fluoro-acrylic graft polymer resin (LF-40, Soken Kagaku) (the coating resin containing a cyclic polyolefin resin recited in claim 2 that was prepared by mixing both compounds at a 50:50 ratio using a kneader) was coated on the surface of ferrite powder (a product of Powdertech) in the same manner as in Example 6 to obtain a carrier.

Example 9

T-745-MO (the polyolefin resin having a cyclic structure recited in claim 3 that was prepared by adding a carboxyl group to T-745 by fusing air oxidation) was coated on the surface of ferrite powder (a product of Powdertech) in the same manner as in Example 6 to obtain a carrier.

Example 10

T-745-CL (the polyolefin resin having a cyclic structure recited in claim 4 that was prepared by adding a peroxide to an ethylene-norbornene-norbornadiene terpolymer to crosslink it) was coated on the surface of ferrite powder (a product of Powdertech) in the same manner as in Example 6 to obtain a carrier.

Comparative Example 1

Fluoro-acrylic polymer (LF-40, Soken Kagaku) was coated on the surface of iron powder (TEF-V150, Powdertech) in the same manner as in Example 1 to obtain a carrier.

Comparative Example 2

Fluoro-acrylic polymer (LF-40, Soken Kagaku) was coated on the surface of ferrite powder (a product of Powdertech) in the same manner as in Example 6 to obtain a carrier.

Table 2 shows the fundamental properties of the polyolefin resins having a cyclic structure that were used in the Examples.

TABLE 2

| Product | Mw | Mn | i.v. | HDT | D | Tg |
|---|---|---|---|---|---|---|
| T745 | 7,000 | 3,800 | 0.19 | less than 70 | 1.8 | 68 |
| S-8007 | 70,000 | 35,000 | 0.25 or more | 70 or more | 2.0 | 80 |
| T745-MO | 6,800 | 3,400 | less than 0.25 | less than 70 | 2.0 | 78 |
| T745-CL | 12,000 | 3,400 | less than 0.25 | less than 70 | 3.5 | 76 |

Fluoro Comb-shaped polymer L series LF-40, Soken Kagaku type

EVALUATIONS

The carriers prepared by the aforementioned carrier preparation method were each fed to a commercially available electrophotographic copier (Vivace 450, Fuji Xerox), and subjected to performance tests. The results are shown in Table 3. Table 3 shows that the carriers of the Examples are superior to the carriers of the Comparative Examples in all of the image sharpness and the anti-spent toner properties.

TABLE 3

| | Image sharpness | Charge control properties | Anti-spent toner properties |
|---|---|---|---|
| Ex.1 | ○ | ○ | ○ |
| Ex.2 | ○ | ○ | ○ |
| Ex.3 | ○ | Δ | Δ |
| Ex.4 | ○ | ○ | ○ |
| Ex.5 | ○ | ○ | ○ |
| Ex.6 | ○ | ○ | ○ |
| Ex.7 | ○ | ○ | ○ |
| Ex.8 | ○ | Δ | Δ |
| Ex.9 | ○ | ○ | ○ |
| Ex.10 | ○ | ○ | ○ |
| Comp. Ex.1 | X | X | X |
| Comp. Ex.2 | Δ | Δ | Δ |

EVALUATION METHODS AND EVALUATION CRITERIA

1) Image Sharpness

The thin line resolving power and the maximum image density of the image after copying of 50,000 papers were compared with those of the image obtained in the initial image. The change rate of less than 10% was evaluated as ○. The change rate of 10% or more but less than 20% was evaluated as Δ. The change rate of 20% or more was evaluated as X.

2) Charge Control Properties

The initial charge of the toner and carrier, and their charge after copying of 30,000 papers were measured with Blowoff 500 of Toshiba Chemical, and comparisons were made. The change rate of less than 5% was evaluated as ○. The change rate of 5% or more but less than 10% was evaluated as Δ. The change rate of 10% or more was evaluated as X.

3) Anti-spent Toner Properties

Each of the carriers described in the Examples and the Comparative Examples, and a toner of Fuji Xerox were put in a developer box in predetermined amounts. These materials were stirred and triboelectrically treated for one week. 5 grams each of the resulting toner-deposited carriers was weighed. The carrier was put in water with soap to remove the toner electrostatically adhering to the surface of the carrier. Only the magnetic carrier powder was withdrawn using a magnet. The magnetic powder was dipped in acetone to dissolve and remove the spent toner fusion bonded to the surface of the powder. The weight of the powder before acetone treatment and the weight of the powder after acetone treatment were compared, and the change in weight was examined. The change rate of less than 0.2% was evaluated as ○. The change rate of 0.2 to 0.5% was evaluated as Δ. The change rate of more than 0.5% was evaluated as X.

The coated carrier for development of an electrostatically charged image of the present invention has a coating resin, wherein the coating resin at least includes a polyolefin resin having a cyclic structure, and a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in an amount of less than 50% by weight based on the entire coating resin. Thus, the coated carrier is excellent in the anti-spent toner effect and charge control properties. A developer containing this carrier can achieve a high grade, sharp image.

What is claimed is:

1. A coated carrier for development of an electrostatically charged image, said coated carrier comprising carrier core particles coated with a coating resin; wherein said coating resin at least includes a polyolefin resin having a cyclic structure;

a polyolefin resin of a cyclic structure having an intrinsic viscosity (i.v.) of 0.25 dl/g or more, a heat distortion temperature (HDT) by DIN53461-B of 70° C. or higher, and a number average molecular weight of 7,500 or more and a weight average molecular weight of 15,000 or more, as measured by GPC, is contained in an amount of less than 50% by weight based on the entire coating resin; and said coating resin is used for coating in an amount of 1 to 30% by weight based on the carrier core particles.

2. The coated carrier of claim 1, wherein said coating resin consists of 1 to 100 parts by weight of a polyolefin resin having a cyclic structure, and 0 to 99 parts by weight of at least one resin selected from fluoro-acrylic graft polymer, cellulose butyl acetate, and silicone resins.

3. The coated carrier of claim 1, wherein said polyolefin resin having a cyclic structure has at least one functional group selected from the group consisting of a carboxyl group, a hydroxyl group and an amino group.

4. The coated carrier of claim 1, wherein said polyolefin resin having a cyclic structure has a structure crosslinked with metallic ions or dienes.

5. The coated carrier of claim 1, wherein the polyolefin resin having a cyclic structure is a colorless and transparent copolymer of an alpha olefin obtained from a polymerization.

6. The coated carrier of claim 1, wherein the polyolefin resin having a cyclic structure has a high light transmittance and is selected from the group consisting of ethylene, propylene or butylene with an alicyclic compound having a double bond, such as cyclohexene or norbornene.

* * * * *